US010396425B2

(12) United States Patent
Ohlsson et al.

(10) Patent No.: US 10,396,425 B2
(45) Date of Patent: Aug. 27, 2019

(54) RADIO FREQUENCY ASSEMBLY

(71) Applicant: HUAWEI TECHNOLOGIES CO., LTD., Shenzhen, Guangdong (CN)

(72) Inventors: Fredrik Ohlsson, Kista (SE); Peter Ekholm, Kista (SE); Joakim Hoppe, Kista (SE); Andrea Putaggio, Kista (SE)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 105 days.

(21) Appl. No.: 15/686,726

(22) Filed: Aug. 25, 2017

(65) Prior Publication Data

US 2017/0352939 A1 Dec. 7, 2017

Related U.S. Application Data

(63) Continuation of application No. PCT/EP2015/054061, filed on Feb. 26, 2015.

(51) Int. Cl.
*H01Q 1/12* (2006.01)
*H01Q 1/24* (2006.01)
*H01Q 1/42* (2006.01)

(52) U.S. Cl.
CPC ..... *H01Q 1/1228* (2013.01); *H01Q 1/125* (2013.01); *H01Q 1/246* (2013.01); *H01Q 1/428* (2013.01)

(58) Field of Classification Search
CPC ..... H01Q 1/1228; H01Q 1/428; H01Q 1/125; H01Q 1/246
USPC ..... 343/882, 890
See application file for complete search history.

(56) References Cited

U.S. PATENT DOCUMENTS 6,222,504 B1 4/2001 Oby
6,232,928 B1 * 5/2001 Zimmerman ..... H01Q 1/1242 343/882
6,739,561 B2 * 5/2004 Herzog ..... H01Q 1/1221 248/218.4

(Continued)

FOREIGN PATENT DOCUMENTS

CN 1395753 A 2/2003
CN 202004144 U 10/2011

(Continued)

OTHER PUBLICATIONS

International Search Report dated Oct. 28, 2015 in corresponding International Patent Application No. PCT/EP2015/054061.

(Continued)

*Primary Examiner* — Khai M Nguyen
(74) *Attorney, Agent, or Firm* — Staas & Halsey LLP

(57) ABSTRACT

A radio frequency assembly (100) is described. The radio frequency assembly (100) comprises a radio frequency unit (102) comprising at least one unit connection member (110, 112) and at least one antenna (168), a bracket (104) comprising at least one bracket connection member (114, 116), and, at least one fastening member (108, 170). At least one of said at least one unit connection member (110, 112) and said at least one bracket connection member (114, 116) is curved. Each unit connection member (110, 112) is configured to be connectable to a respective bracket connection member (114, 116) with use of the fastening member (108, 170).

19 Claims, 8 Drawing Sheets

(56) References Cited

U.S. PATENT DOCUMENTS

| | | | | |
|---|---|---|---|---|
| 7,106,273 | B1 * | 9/2006 | Brunson | H01Q 1/1228 343/878 |
| 2004/0027307 | A1 | 2/2004 | Hossein | |
| 2013/0256477 | A1 | 10/2013 | Fackler | |
| 2014/0033496 | A1 | 2/2014 | Lettkeman et al. | |
| 2014/0225782 | A1 | 8/2014 | Sanford | |

FOREIGN PATENT DOCUMENTS

| | | | |
|---|---|---|---|
| CN | 102637942 | A | 8/2012 |
| CN | 103915691 | A | 7/2014 |
| EP | 1111290 | A1 | 6/2001 |
| EP | 0941555 | B1 | 7/2001 |
| FR | 2539920 | | 7/1984 |
| GB | 1530551 | | 11/1978 |
| GB | 2190246 | A | 11/1987 |
| JP | 2001-292015 | | 10/2001 |
| JP | 2012034187 | A | 2/2012 |

OTHER PUBLICATIONS

Written Opinion of the International Searching Authority dated Oct. 28, 2015 in corresponding International Patent Application No. PCT/EP2015/054061.

International Search Report dated Oct. 28, 2015 in corresponding International Patent Application No. PCT/2015/054061.

Office Action, dated Jan. 21, 2019, in Chinese Application No. 201580075527.3 (10 pp.).

* cited by examiner

RADIO FREQUENCY ASSEMBLY

CROSS-REFERENCE TO RELATED APPLICATIONS

This application is a continuation of International Application No. PCT/EP2015/054061, filed on Feb. 26, 2015, the disclosure of which is hereby incorporated by reference in its entirety.

TECHNICAL FIELD

The present invention relates to a radio frequency assembly. More specifically the present invention relates to a radio frequency unit and a bracket configured for attachment of the radio frequency unit to the bracket and for attachment of the bracket to an attachment surface.

BACKGROUND

In a city there is a large demand for telecommunication services. This is achieved by arranging a large number of base stations over the city. Small integrated base stations (BTS), may be installed on poles such as, e.g., light poles, street sign poles and walls. The BTS contains radio and antenna components and may also contain base band functionality. The base band functionality may be implemented as an external or remote solution. In some cases only the antenna of the BTS is installed on the poles. In this application the word radio frequency unit is used for the equipment to be installed on the pole. Thus, the radio frequency unit comprises at least an antenna. It is vital that the installation of the radio frequency unit is very easy and quick to do for one person, and that it requires only basic tools. It must be easy to quickly adjust the azimuth angle (horizontal antenna radiation angle). It should also be possible to mount as many as three radio frequency units around a pole, on the same height, without interfering with each other or affecting each other. Thus, it is desirable if the radio frequency units may be installed and uninstalled in any order, so that the radio frequency unit that is installed firstly may be uninstalled firstly.

An existing method for angle adjustment of radio frequency units is to use an adjustable bracket placed on the lower end of the radio frequency unit. The adjustable bracket is a bracket having multiple parts which are joined in a rotation interface. The design rotational axis is placed between the radio frequency unit and the installation pole/wall, and is thus arranged at the joint between two parts of the bracket.

The solutions according to conventional technology are relatively large. This leads to the distance between the pole and the radio frequency unit becoming large, which in turn leads to higher forces on the bracket and also contribute to undesirable appearance.

The solutions according to conventional technology also have the drawback that two brackets are needed which makes the installation time longer and more difficult. Vertical alignment accuracy of the radio frequency unit is difficult with solutions according to conventional technology.

SUMMARY

An objective of the present invention is to provide a solution which mitigates or solves the drawbacks and problems of conventional solutions.

Another objective of the present invention is to provide a radio frequency assembly with which the distance between the attachment surface and the radio frequency unit can be made smaller than in solution according to conventional technology.

An "or" in this description and the corresponding claims is to be understood as a mathematical OR which covers "and" and "or", and is not to be understood as an XOR (exclusive OR).

The above objectives are fulfilled by the subject matter of the independent claims. Further advantageous implementation forms of the present invention can be found in the dependent claims.

According to a first aspect of the present invention a radio frequency assembly is provided which comprises a radio frequency unit comprising at least one unit connection member and at least one antenna, a bracket comprising at least one bracket connection member, and at least one fastening member. At least one of said at least one unit connection member and said at least one bracket connection member is curved. Each unit connection member is configured to be connectable to a respective bracket connection member with use of the fastening member.

In this application radio frequency should be interpreted as the frequency range from 1 MHz to 300 GHz.

A radio frequency unit in a radio frequency assembly according to the first aspect comprises at least one antenna. The radio frequency unit may also comprise an integrated radio unit. It is also possible that the radio frequency unit comprises a base station.

In solutions according to conventional technology the azimuth adjustment is arranged between the pole/wall and a radiofrequency unit such as a base station. The disadvantage of such solutions according to conventional technology is that the distance between the pole and the radiofrequency unit is relatively large. A large distance between the pole and the radiofrequency unit will result in large forces on the bracket and also contribute to an undesirable appearance of the installation of the radio frequency unit on a pole.

Another problem is that, with the azimuth rotation axis offset from the centre of the radio frequency unit there is a risk of interference with other antennas or equipment during adjustment. The total volume required for the installation of solutions according to conventional technology is 3 times larger than the volume required for installation of a radio frequency assembly according to the first aspect. The total weight of the bracket is halved compared to conventional solutions.

The first aspect provides a solution to the problems with the prior art. As at least one of said at least one unit connection member and said at least one bracket connection member is curved the distance between the pole and the radio frequency unit may be kept small. At the same time the first aspect enables rotation of the radio frequency unit.

In a first possible implementation form of a radio frequency assembly according to the first aspect, the curved of said at least one unit connection member and said at least one bracket connection member is curved around an axis, wherein the axis is parallel to an attachment surface when the radio frequency assembly is attached to the attachment surface. The first implementation form enables rotation of the radio frequency unit around an axis which is parallel to the attachment surface.

In a second possible implementation form of a radio frequency assembly according to the first possible implementation form of the first aspect or to first aspect as such, only said at least one unit connection member is curved. The second possible implementation form of a radio frequency assembly enables the bracket to be compact. This is advantageous as the manufacturing cost for the bracket is minimized in this way. The radio frequency unit is normally sufficiently large to house a curved unit connection member without affecting the size of the radio frequency unit. Thus, the second possible implementation form enables minimization of the overall size of the radio frequency assembly.

In a third possible implementation form of a radio frequency assembly according to the second possible implementation form of the first aspect, at least one bracket connection member defines a hole or a slit, wherein the fastening member is configured to extend through the hole or the slit. It is possible to have the bracket connection member configured differently. However, a hole or a slit enables the use of a fastening member such as a screw or bolt.

In a fourth possible implementation form of a radio frequency assembly according to the third possible implementation form of the first aspect, the hole is formed as a keyhole to enable one of said at least one fastening member to enter through a wide part of the hole and engage with a narrow part of the hole. This is an advantageous design of the bracket connection member as this enables the radio frequency unit to be temporarily attached to the bracket. The fastening member may be at least one screw that is temporarily attached to the radio frequency unit. The bracket may be pre-installed on the pole. The installation of the radio frequency unit on the bracket is then done easily by hooking the screw onto the hole formed as a keyhole so that the screw enters the narrow part of the keyhole. Finally, the screw may be tightened to get the screw in engagement with the narrow part of the keyhole.

In a fifth possible implementation form of a radio frequency assembly according to any one of the second and third possible implementation forms of the first aspect, each unit connection member comprises at least one flange. The flange extends along the unit connection member. The fastening member is configured to be engagable with the flange. By having the unit connection member in the form of a flange it is easy to design a suitable fastening member.

In a sixth possible implementation form of a radio frequency assembly according to any one of the second to fifth possible implementation forms of the first aspect, each unit connection member comprises a groove extending along the unit connection member, wherein the fastening member is configured to be engagable with the groove. By arranging the unit connection member to comprise a groove the distance between the radio frequency unit and the attachment surface may be minimized as only the bracket has to be between the radio frequency unit and the attachment surface. The groove may be configured in many different ways to allow engagement of the fastening member with the groove.

In a seventh possible implementation form of a radio frequency assembly according to the sixth possible implementation form of the first aspect, the flange is arranged in the groove. By arranging the flange in the groove the flange and the fastening member may engage with each other while the distance between the radio frequency unit and the attachment surface may be kept small.

In an eighth possible implementation form of a radio frequency assembly according to the seventh possible implementation form of the first aspect, two parallel flanges are arranged in each groove. Each fastening member comprises a slider slidably configured in each groove and a connector, wherein the connector is configured to engage with the bracket connection member and is connectable to the slider, and wherein the slider and the connector are configured to attach the bracket connection member to the unit connection member. By having two parallel flanges in the groove it is possible to arrange a slider in the groove on the inside of the parallel flanges. The flanges may be made thin so that the distance between the slider and the bracket may be made small. It is advantageous to have a small distance between the slider and the bracket to minimize the forces on the fastening member.

In a ninth possible implementation form of a radio frequency assembly according to any one of the preceding implementation forms of the first aspect or to the first aspect as such, the bracket is configured to be attached to an attachment surface using at least one screw. By configuring the bracket to be attached to an attachment surface using at least one screw it is possible to use the same bracket for attachment to a plane surface and to a pole.

In a tenth possible implementation form of a radio frequency assembly according to any one of the preceding implementation forms of the first aspect or to the first aspect as such, the bracket comprises at least one slot or indentation for a band for attachment of the bracket to an attachment surface of a pole. By providing a slot or indentation for a band in the bracket the radio frequency unit may be arranged close to the bracket while there is still room for a band for attachment of the bracket to a pole.

In an eleventh possible implementation form of a radio frequency assembly according to the tenth possible implementation form of the first aspect, the bracket defines a contact surface, wherein the bracket is configured to be in contact with the attachment surface of the pole along the contact surface, wherein a contact surface indentation is arranged in the contact surface of the bracket, and wherein the contact surface indentation is sufficiently large for at least two bands to be arranged in the contact surface indentation adjacent to each other along the longitudinal axis of the pole. By having such a contact surface indentation in the contact surface of the bracket it is possible to attach more than one radio frequency assembly at the same height on the same pole while still allowing the radio frequency assemblies to the detached in any order. When attaching a second radio frequency assembly with a second bracket after a first radio frequency assembly with a first bracket the band is arranged in the slot or indentation of the second bracket and in the contact surface indentation of the first bracket. The band attaching the second bracket will then not interfere with the first bracket which makes it possible to detach the first bracket while the second bracket is still attached to the pole.

In a twelfth possible implementation form of a radio frequency assembly according to any one of the ninth to eleventh possible implementation form of the first aspect, the radio frequency assembly further comprises adjustment screws at one end of the bracket, wherein the adjustment screws are configured to extend an adjustable distance out from the side of the bracket facing the attachment surface, in order to adjust the angle between the radio frequency unit and the attachment surface by adjustment of the adjustment screws. By the radio frequency assembly comprising adjustment screws it is possible to adjust the angle of the radio frequency unit in relation to the longitudinal axis of the pole while still keeping the bracket connection member and the unit connection member uncomplicated.

In a thirteenth possible implementation form of a radio frequency assembly according to any one of the preceding implementation forms or to the first aspect as such, the radio frequency unit is configured to be attached to an attachment surface with the longitudinal axis in an angle to the attachment surface, wherein the angle is in the interval 0-10°. By having an angular adjustability the radio frequency unit may be adjusted to the specific environment in which it is installed.

In a possible implementation form of a radio frequency assembly according to any one of the preceding implementation forms or to the first aspect as such the radio frequency unit or parts of it are cylindrical. According to another possible implementation form the radio frequency unit is partly or entirely circularly cylindrical. A partly cylindrical, partly circularly or entirely circularly cylindrical radio frequency unit allows attachment close to the pole without any risk for the radio frequency unit to get into contact with the attachment surface during adjustment of the radio frequency unit during adjustment of the position of the unit connection member in relation to the bracket connection member. It is of course also possible to avoid that the radio frequency unit gets into contact with the attachment surface by arranging an arbitrarily shaped radio frequency unit at an appropriate distance from the attachment surface.

SHORT DESCRIPTION OF THE DRAWINGS

Figure 2:
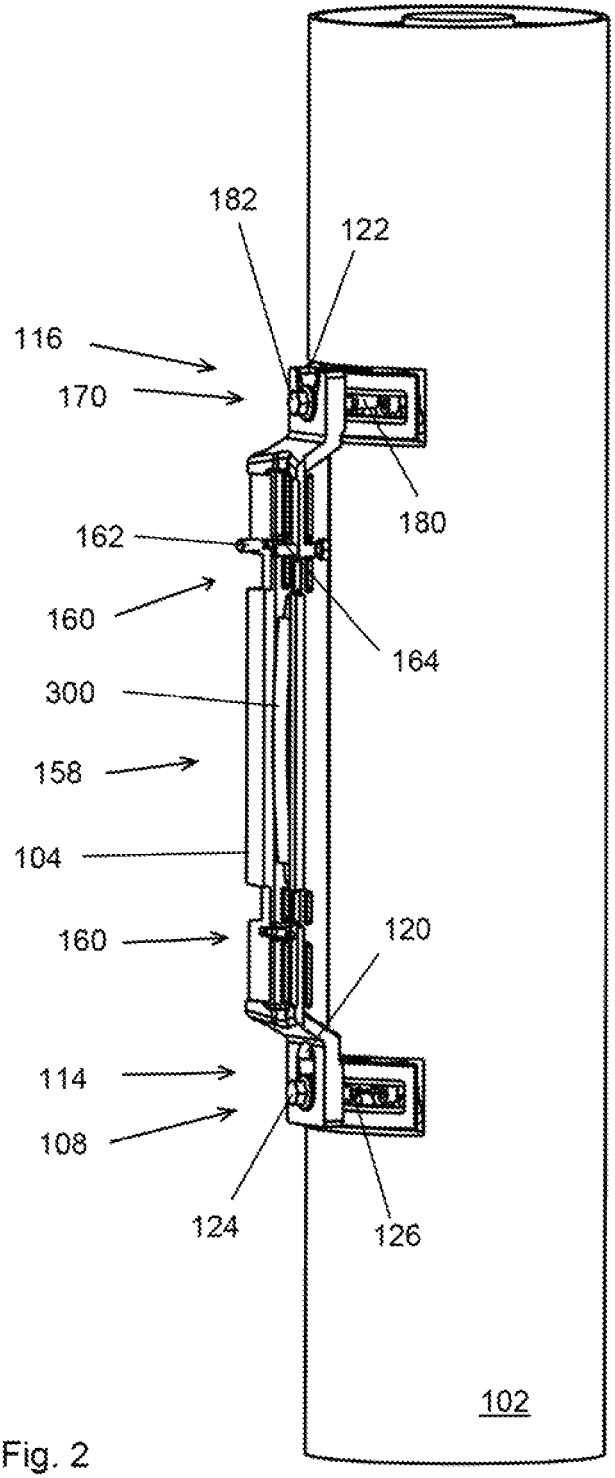
FIG. 2 shows schematically in a perspective view a radio frequency assembly comprising a radio frequency unit, a bracket and a fastening member.
Figure 3A:
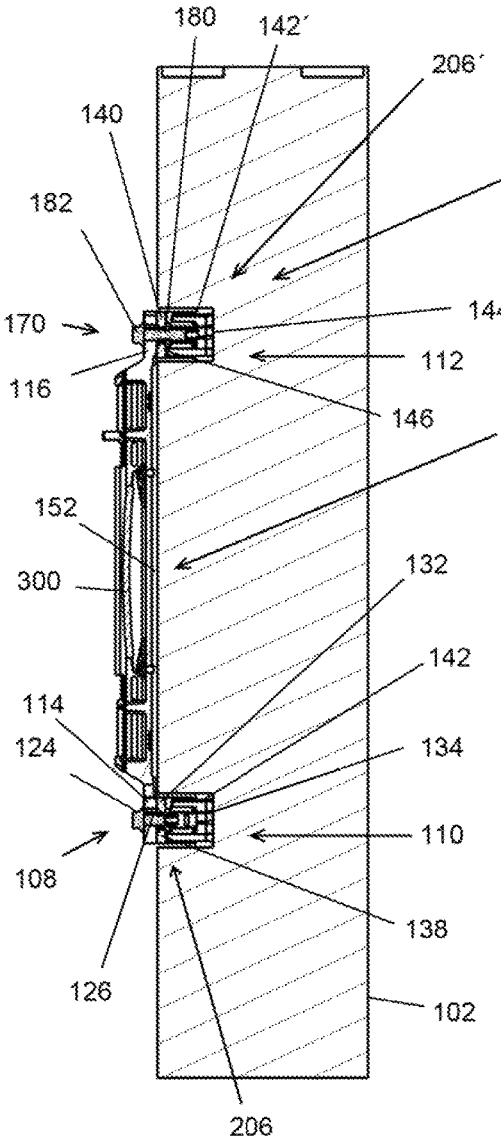

FIG. 3*a* shows schematically in cross section the radio frequency unit of FIG. 2 in cross section.

Figure 3B:
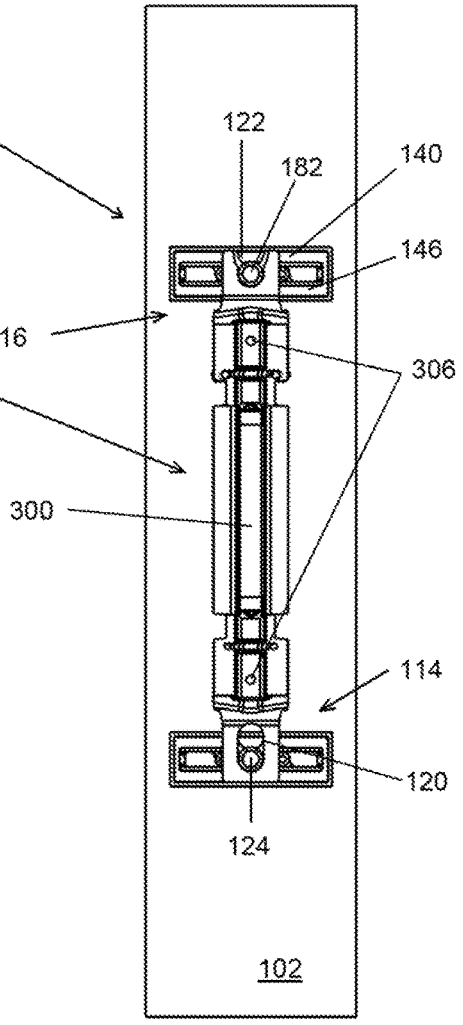

FIG. 3*b* is a schematic plan view of the radiofrequency unit of FIG. 2.

Figure 4:
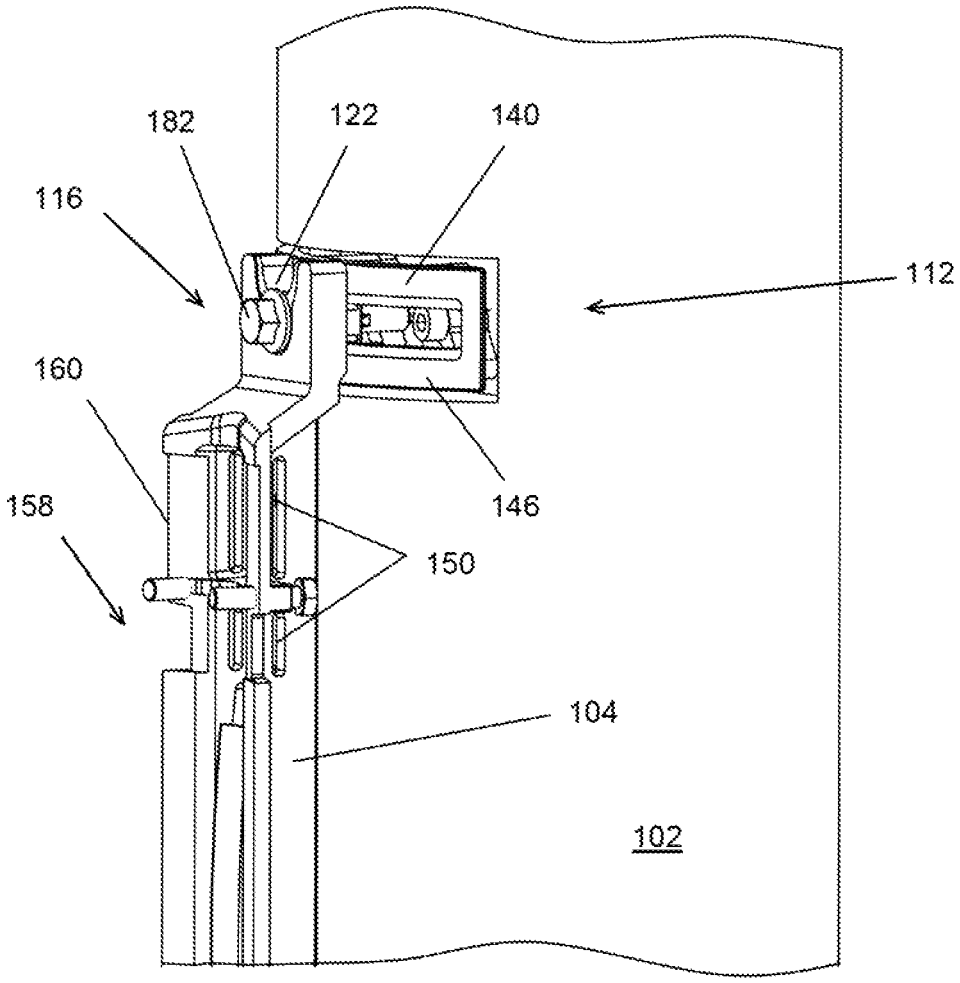

FIG. 4 shows in more detail one of the unit connection members and one of the bracket connection members in the radio frequency assembly of FIGS. 2 and 3.

Figure 5:
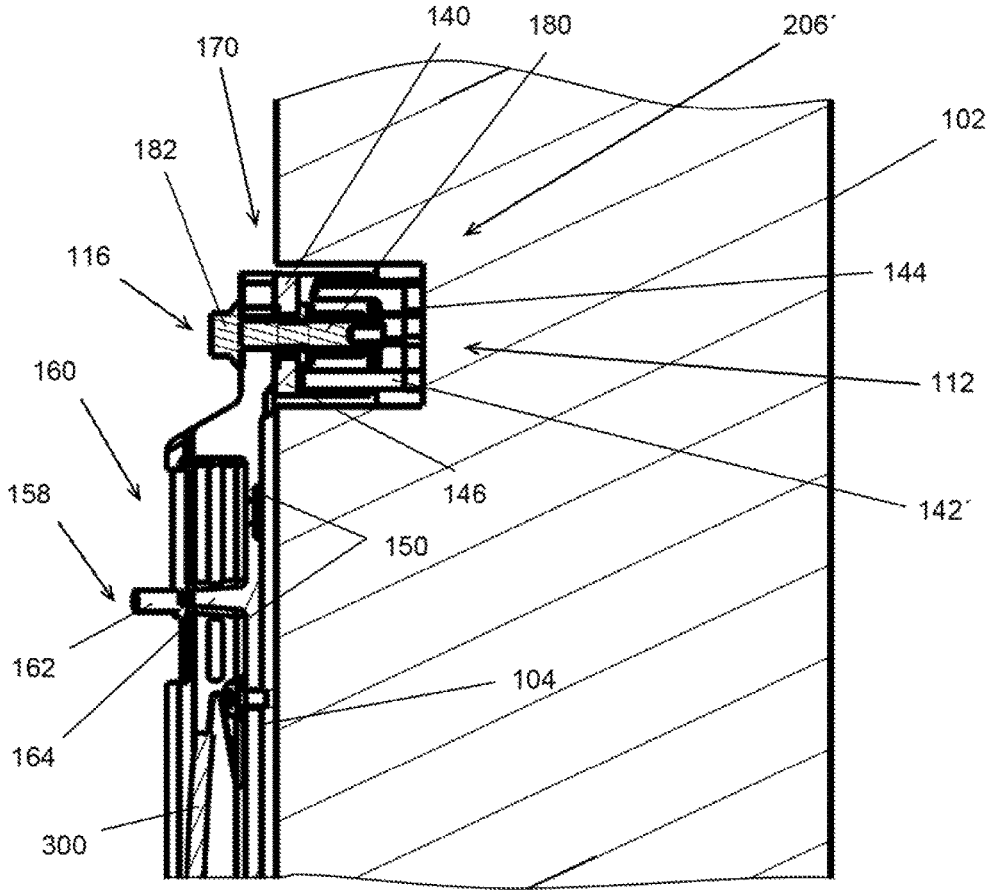

FIG. 5 shows in more detail in cross section one of the unit connection members and one of the bracket connection members in the radio frequency assembly of FIGS. 2, 3 and 4.

Figure 6:
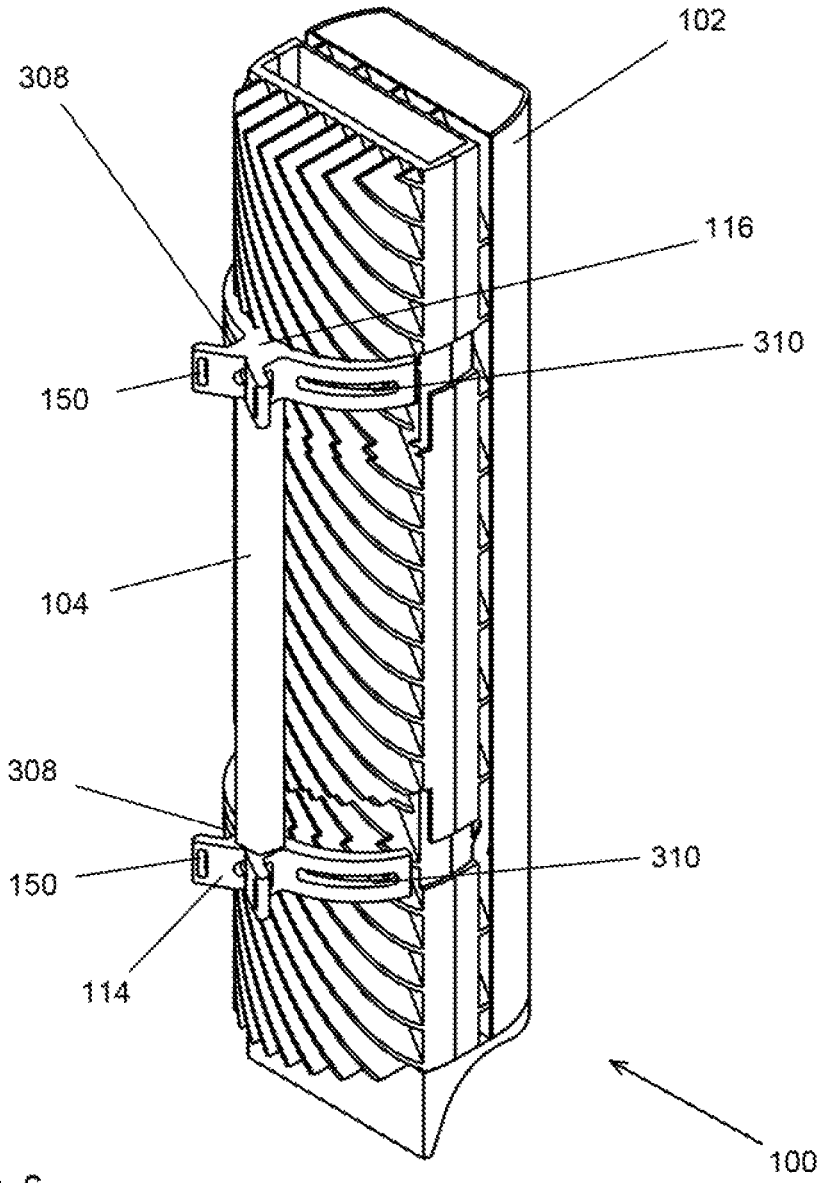

FIG. 6 is a perspective view of a radio frequency assembly according to an alternative embodiment.

Figure 7:
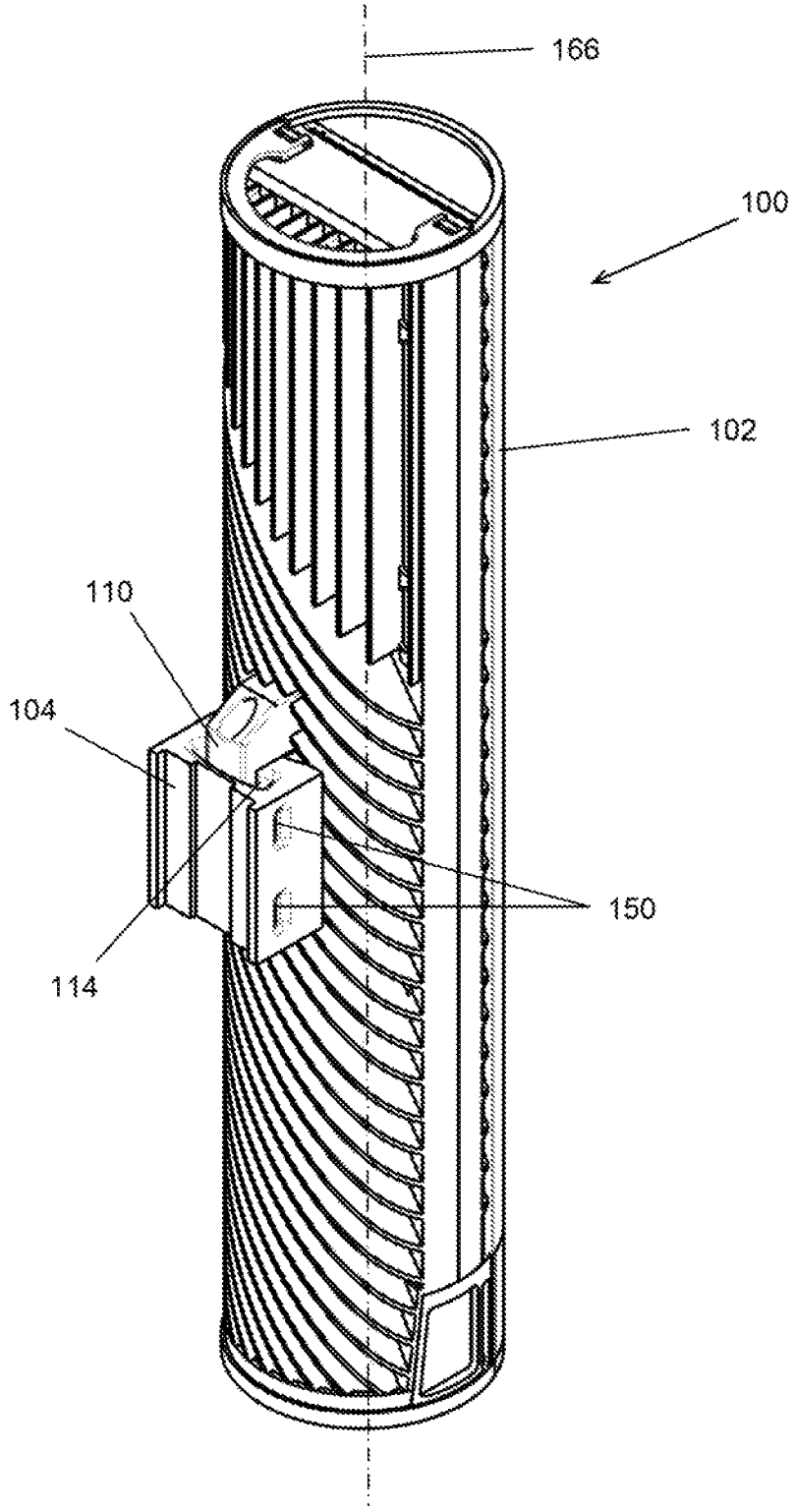

FIG. 7 is a perspective view of a radio frequency assembly according to an alternative embodiment.

Figure 8:
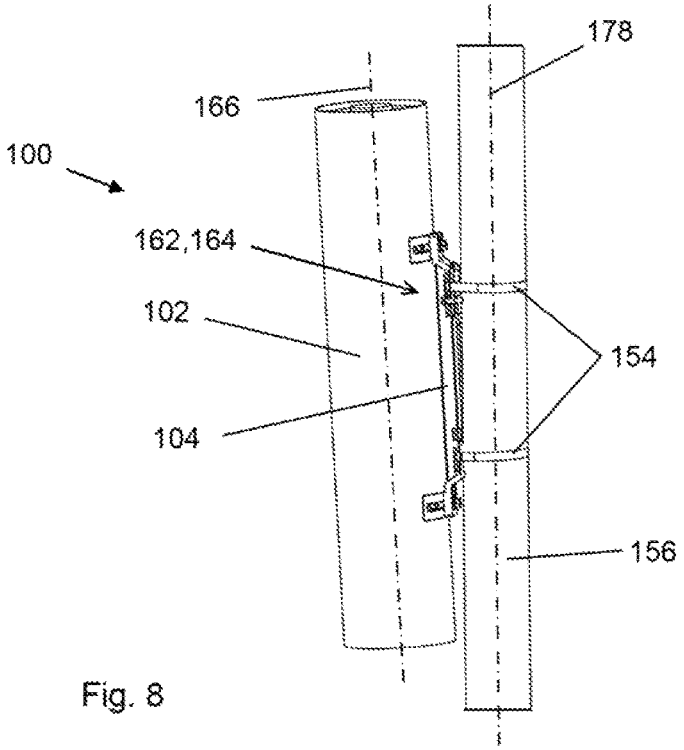

FIG. 8 shows schematically the radio frequency assembly according to FIGS. 2-4 being attached to a pole, wherein the radio frequency assembly is attached in an angle to the pole.

Figure 9:
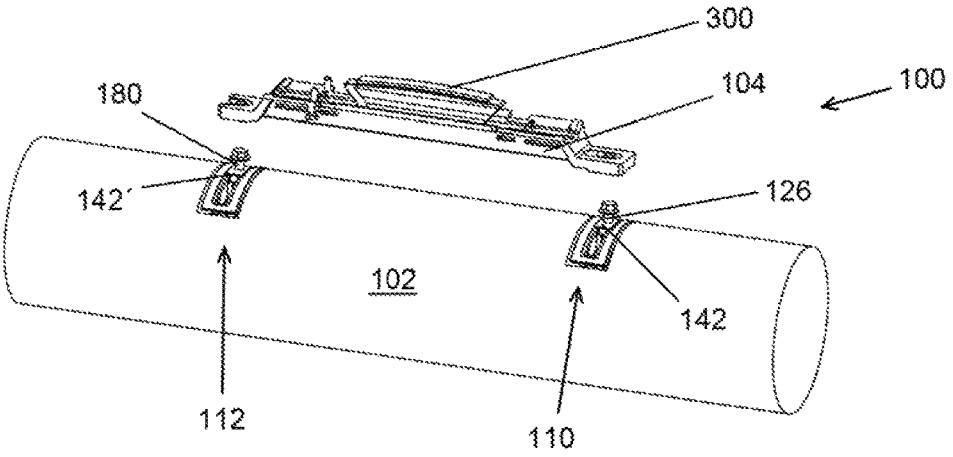

FIG. 9 shows schematically the radio frequency assembly according to FIGS. 2-4, wherein the bracket is not attached to the radio frequency unit.

DETAILED DESCRIPTION

In the following detailed description of embodiments of the invention the same reference numeral will be used for the corresponding feature in the different drawings. The drawings are not drawn to scale.

Figure 1:
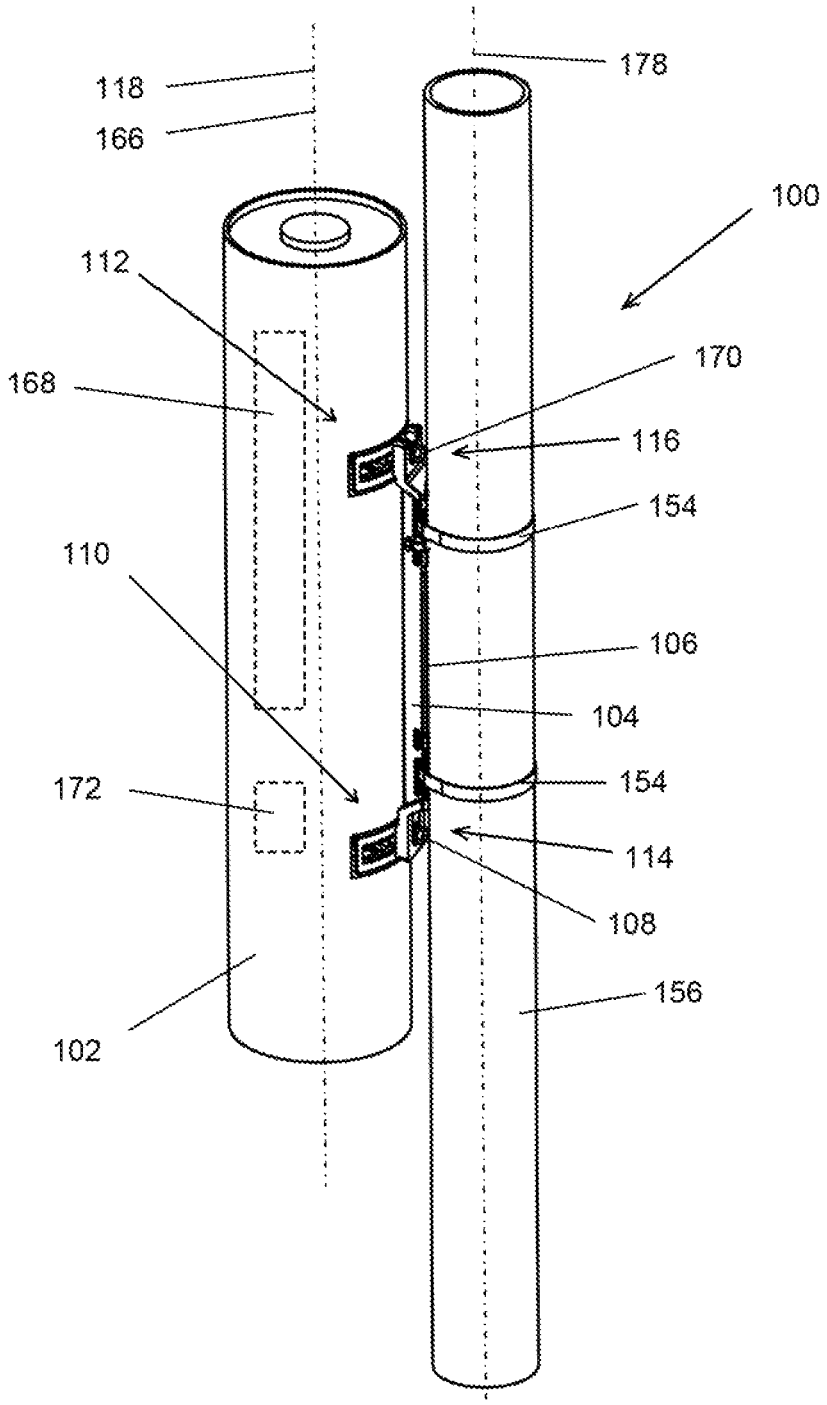
FIG. 1 shows schematically a radio frequency assembly being attached to a pole.

FIG. 1 shows schematically a radio frequency assembly 100 attached to a pole 156. The radio frequency assembly 100 comprises a radio frequency unit 102 comprising an antenna 168, a bracket 104, a first fastening member 108 and a second fastening member 170. The radio frequency unit also comprises an integrated radio unit 172. The radio frequency unit 102 comprises a first unit connection member 110 and a second unit connection member 112. The bracket 104 comprises a first bracket connection member 114 and a second bracket connection member 116. The bracket is connected to a pole 156 using bands 154. The pole comprises a longitudinal axis 178 and an attachment surface 106. The radio frequency unit 102 comprises a longitudinal axis 166. The longitudinal axis 166 of the radio frequency unit 102 coincides with an axis 118. The axis 118 is parallel to the attachment surface 106 of the pole 156. The first unit connection member 110 and the second unit connection member 112 are curved around the axis 118. The first unit connection member 110 is connected to the first bracket connection member 114 with use of the first fastening member 108 and the second fastening member 170.

The first bracket connection member 114 is connected to the first unit connection member 110 and the second bracket connection member 116 is connected to the second unit connection member 112, in a first position in FIG. 1. The first bracket connection member 114 may be moved along the first unit connection member 110 and the second bracket connection member 116 may be moved along the second unit connection member 112 to a second position (not shown). As the first unit connection member 110 and the second unit connection member 112 are curved the angle of the radio frequency unit 102 will change between the first and the second position. In this way the azimuth angle of the antenna in the radio frequency unit is adjustable.

FIG. 2 shows schematically in a perspective view a radio frequency assembly 100 comprising a radio frequency unit 102, a bracket 104, a first fastening member 108 and a second fastening member 170. The first bracket connection member 114 defines a hole 120. The hole 120 is formed as a keyhole. The second bracket connection member 116 defines a slit 122 which is open from the top in the figure. The first fastening member 108 comprises a first screw 126 with a first screw head 124. The second fastening member 170 comprises a second screw 180 with a second screw head 182. The side of the bracket 104 facing the attachment surface 106 (FIG. 1) defines a contact surface 158. The bracket 104 is configured to be in contact with the attachment surface 106 (FIG. 1) of the pole 156 (FIG. 1) along the contact surface 158. Contact surface indentations 160 are configured in the contact surface 158 of the bracket 104. The contact surface indentations 160 are sufficiently large for at least two bands 154 (FIG. 1) to be arranged in each contact surface indentation 160 adjacent to each other along the longitudinal axis 178 of the pole 156 (FIG. 1).

Also shown in FIG. 2 are adjustment screws 162, 164, at one end of the bracket 104. The adjustment screws 162, 164, are configured to extend an adjustable distance out from the side of the bracket 104 facing the attachment surface 106 (FIG. 1), in order to adjust the angle between the radio frequency unit 102 and the attachment surface 106 by adjustment of the adjustment screws 162, 164. The radio frequency unit 102 is configured to be attached to an attachment surface 106 (FIG. 1) with the longitudinal axis 166 in an angle to the attachment surface 106. The angle is adjustable in the interval 0-10° using the adjustment screws 162, 164.

FIG. 3*a* shows schematically in cross section the radio frequency unit 102 of FIG. 2. FIG. 3*b* is a schematic plan view of the radiofrequency unit 102 of FIG. 2. In FIGS. 3*a* and 3*b* is more clearly seen that the first unit connection member 110 comprises a first groove 134, extending along the first unit connection member 110. The first fastening member 108 is configured to be engagable with the first groove 134. Two parallel flanges 132, 138, are arranged in the first groove 134. The first fastening member 108 comprises a first slider 142, slidably configured in the first groove 134, and a first connector 206, which is the first screw 126 with the first screw head 124. The first connector 206, in the form of the first screw 126 is connectable to the first slider 142. The first connector is configured to engage with the first bracket connection member 114. In this way the first slider 142 and the first connector 206 are configured to attach the first bracket connection member 114 to the first unit connection member 110. Correspondingly, the second unit connection member 112 comprises a second groove 144, extending along the second unit connection member 112. The second fastening member 170 is configured to be engagable with the second groove 144. Two parallel flanges 140, 146, are arranged in the second groove 144. The second fastening member 170 comprises a second slider 142', slidably configured in the second groove 144, and a second connector 206', which is the second screw 180 with the second screw head 182. The second connector 206', in the form of the second screw 180 is connectable to the second slider 142'. The second connector 206' is configured to engage with the second bracket connection member 116. In this way the second slider 142' and the second connector 206' are configured to attach the second bracket connection member 116 to the second unit connection member 112. Also shown in FIG. 3*a* and FIG. 3*b* is a foldable handle 300 which may be used to carry the assembled radio frequency assembly 100. When the handle 300 is not used it may be folded to the position shown in FIG. 3*a* and FIG. 3*b*.

As is most clearly shown in FIG. 3*b* the first bracket connection member 114 defines a hole 120 while the second bracket connection member 116 defines a slit 122. The hole 120 is formed as a keyhole to enable the first screw head 124 of the first screw 126 to enter through a wide part of the hole 120 and engage with a narrow part of the hole 120. In FIG. 3*a* and FIG. 3*b* the first screw head 124 is in engagement with the narrow part of the hole 120. The second screw head 182 is in engagement with the slit 122.

In FIG. 3*b* is also shown attachment holes 306. Attachment screws (not shown) are can be arranged through the attachment holes 306 for attachment of the bracket 104 to an attachment surface 106 (FIG. 1).

The bracket 104 may be attached to the attachment surface using bands 154 (FIG. 1) such as steel bands. The bracket 104 comprises slots 150 for a band 154 for attachment of the bracket 104 to an attachment surface 106 (FIG. 1) of a pole 156 (FIG. 1). The bracket 104 also comprises an indentation 152 for a band 154 for attachment of the bracket to an attachment surface. It is preferable to use the slots 150 for attachment of the bracket to the attachment surface.

FIG. 4. shows in more detail the second unit connection member 112 and the second bracket connection member 116 in the radio frequency assembly of FIGS. 2 and 3. The flanges 140, 146, are more clearly seen in FIG. 4. Also the second screw head 182, the slit 122 and the slots 150 are more clearly seen in FIG. 4. The bracket 104 defines a contact surface 158. The bracket 104 is configured to be in contact with the attachment surface 106 (FIG. 1) of the pole 156 (FIG. 1) along the contact surface 158. A contact surface indentation 160 is arranged in the contact surface 158 of the bracket 104. The contact surface indentation 160 is sufficiently large for at least two bands 154 (FIG. 1) to be arranged in the contact surface indentation 160 adjacent to each other along the longitudinal axis 178 (FIG. 1) of the pole 156 (FIG. 1). The bracket 104 may be attached to an attachment surface using bands 154 (FIG. 1) extending through the slots 150. Bands 154 (FIG. 1) attaching other radio frequency assemblies 100 to the pole 156 (FIG. 1), at the same height, may extend through the contact surface indentations 160. In this way it is possible to detach any one of the radio frequency assemblies irrespective of the order in which they were attached to the pole 156 (FIG. 1). By having a contact surface indentation 160 in the contact surface 158 of the bracket 104 it is possible to attach more than one radio frequency assembly 100 at the same height on the same pole 156 (FIG. 1) while still allowing the radio frequency assemblies to the detached in any order. When attaching a second radio frequency assembly 100 with a second bracket 104 after a first radio frequency assembly 100 with a first bracket 104 the band 154 is arranged in the slot 150 of the second bracket 104 and in the contact surface indentation 160 of the first bracket 104. The band 154 attaching the second bracket 104 will then not interfere with the first bracket 104 which makes it possible to detach the first bracket 104 while the second bracket 104 is still attached to the pole 156 (FIG. 1).

FIG. 5 shows in more detail in cross section the second unit connection member 112 and the second bracket connection member 116 in the radio frequency assembly of FIGS. 2, 3 and 4. The second unit connection member 112 comprises a second groove 144, extending along the second unit connection member 112. The second fastening member 170 is configured to be in engagement with the second groove 144. Two parallel flanges 140, 146, are arranged in the second groove 144. The second fastening member 170 comprises a second slider 142', slidably configured in the second groove 144, and a second connector 206', which is the second screw 180 with the second screw head 182. The second connector 206', in the form of the second screw 180 is connectable to the second slider 142'. The second connector 206' is configured to engage with the second bracket connection member 116. Also shown in FIG. 5 is a handle 300 which may be used to carry the radio frequency assembly 100.

Also shown in FIG. 5 are adjustment screws 162, 164, at one end of the bracket 104. The adjustment screws 162, 164, are configured to extend an adjustable distance out from the side of the bracket 104 facing the attachment surface 106 (FIG. 1), in order to adjust the angle between the radio frequency unit 102 and the attachment surface 106 by adjustment of the adjustment screws 162, 164. The angle is adjustable in the range 0-10°.

FIG. 6 is a perspective view of a radio frequency assembly 100 according to an alternative embodiment. In the embodiment shown in FIG. 6 the bracket 104 comprises a first bracket connection member 114 which is curved and a second bracket connection member 116 which is also curved. Each of the bracket connection members comprises two slits 308, 310. A fastening member in the form of a screw with a screwhead (not shown) is arrangable through the slits 308, 310 into the radio frequency unit 102. The screws are fixed in relation to the radio frequency unit 102 but are movable in relation to the slits 308, 310. Thus, by rotating the radiofrequency unit and the screws in relation to the slits 308, 310, the azimuth angle of the radio frequency unit is adjustable. The bracket 104 also comprises slots 150. Bands may be arranged through the slots 150 for attachment of the radio frequency unit to a pole 156 (FIG. 1).

FIG. 7 is a perspective view of a radio frequency assembly 100 according to an alternative embodiment. In the embodiment shown in FIG. 7 the radio frequency unit 102 comprise only one unit connection member 110 and one bracket connection member 114. The unit connection member 110 is in the form of a curved flange. The bracket connection member 114 is in the form of a curved slit. The unit connection member 110 is in engagement with the bracket connection member 114 in FIG. 7. The bracket 104 also comprises slots 150 for attachment of the radio frequency unit to a pole 156 using bands 154 (FIG. 1).

FIG. 8 shows schematically a radio frequency assembly 100 being attached to a pole 156. The bracket 104 of the radio frequency assembly is attached to the pole 156 with bands 154. The radio frequency assembly 100 is attached to the pole 156 so that the longitudinal axis 178 of the pole 156 is in an angle to the longitudinal axis of the radio frequency unit 102. This has been achieved by adjustment of the adjustment screws 162, 164.

FIG. 9 shows schematically the radio frequency assembly 100 according to FIGS. 2-4, wherein the bracket 104 is not attached to the radio frequency unit 102. The first slider 142 is arranged in the first unit connection member 110 and the first screw 126 is attached to the first slider 142. The second slider 142' is arranged in the second unit connection member 112 and the second screw 180 is attached to the second slider 142'. The handle 300 is shown in its unfolded position.

When the radio frequency assembly 100 is to be installed on an attachment surface the bracket may be installed firstly together with the first slider 142, the second slider 142', the first screw 126 and the second screw 180. The radio frequency unit 102 may then be attached to the bracket by hanging it onto the first screw 126 and the second screw 180. Finally the first screw 126 and the second screw 180 are tightened to secure the radio frequency unit 102 in the desired position on the attachment surface 106.

The invention claimed is:

1. A radio frequency assembly comprising:

a radio frequency unit comprising at least one unit connection member and at least one antenna;

a bracket comprising at least one bracket connection member;

at least one fastening member, wherein:

at least one of said at least one unit connection member and said at least one bracket connection member is curved; and each unit connection member is configured to be connectable to a respective bracket connection member with use of the fastening member, and the bracket is configured to be attached to an attachment surface using at least one screw; and adjustment screws at one end of the bracket, wherein the adjustment screws are configured to extend an adjustable distance out from the side of the bracket facing the attachment surface, in order to adjust the angle between the radio frequency unit and the attachment surface by adjustment of the adjustment screws.

2. The radio frequency assembly according to claim 1, wherein the curved of said at least one unit connection member and said at least one bracket connection member is curved around an axis, wherein the axis is parallel to an attachment surface when the radio frequency assembly is attached to the attachment surface.

3. The radio frequency assembly according to claim 1, wherein said at least one unit connection member is curved.

4. A radio frequency assembly comprising:

a radio frequency unit comprising at least one unit connection member and at least one antenna;

a bracket comprising at least one bracket connection member; and at least one fastening member;

wherein:

said at least one unit connection is curved, each unit connection member is configured to be connectable to a respective bracket connection member with use of the fastening member, each unit connection member comprises at least one flange, the flange extends along the unit connection member, and the fastening member is configured to be engagable with the flange.

5. The radio frequency assembly according to claim 4, wherein at least one bracket connection member defines a hole or a slit, wherein the fastening member is configured to extend through the hole or the slit.

6. The radio frequency assembly according to claim 5, wherein the hole is formed as a keyhole to enable one of said at least one fastening member to enter through a wide part of the hole and engage with a narrow part of the hole.

7. The radio frequency assembly according to claim 4, wherein the bracket comprises at least one slot or indentation for a band for attachment of the bracket to an attachment surface of a pole.

8. The radio frequency assembly according to claim 7, wherein the bracket defines a contact surface, wherein the bracket is configured to be in contact with the attachment surface of the pole along the contact surface, wherein a contact surface indentation is arranged in the contact surface of the bracket, and wherein the contact surface indentation is sufficiently large for at least two bands to be arranged in the contact surface indentation adjacent to each other along the longitudinal axis of the pole.

9. The radio frequency assembly according to claim 4 wherein the radio frequency unit is configured to be attached to an attachment surface with the longitudinal axis in an angle to the attachment surface, wherein the angle is in the interval 0-10°.

10. The radio frequency assembly according to claim 4, wherein the curved of said one unit connection member is curved around an axis parallel to an attachment surface when the radio frequency assembly is attached to the attachment surface.

11. A radio frequency assembly comprising:

a radio frequency unit comprising at least one unit connection member and at least one antenna;

a bracket comprising at least one bracket connection member; and at least one fastening member;

wherein:

said at least one unit connection is curved, each unit connection member is configured to be connectable to a respective bracket connection member with use of the fastening member, each unit connection member comprises a groove extending along the unit connection member, and the fastening member is configured to be engagable with the groove.

12. The radio frequency assembly according to claim 11, wherein the flange is arranged in the groove.

13. The radio frequency assembly according to claim 12, wherein two parallel flanges are arranged in each groove, wherein each fastening member comprises a slider slidably configured in each groove and a connector, wherein the connector is configured to engage with the bracket connection member and is connectable to the slider, and wherein the slider and the connector are configured to attach the bracket connection member to the unit connection member.

14. The radio frequency assembly according to claim 11, wherein the curved of said one unit connection member is curved around an axis parallel to an attachment surface when the radio frequency assembly is attached to the attachment surface.

15. The radio frequency assembly according to claim 11, wherein at least one bracket connection member defines a hole or a slit, wherein the fastening member is configured to extend through the hole or the slit.

16. The radio frequency assembly according to claim 15, wherein the hole is formed as a keyhole to enable one of said at least one fastening member to enter through a wide part of the hole and engage with a narrow part of the hole.

17. The radio frequency assembly according to claim 11, wherein the bracket comprises at least one slot or indentation for a band for attachment of the bracket to an attachment surface of a pole.

18. The radio frequency assembly according to claim 17, wherein the bracket defines a contact surface, wherein the bracket is configured to be in contact with the attachment surface of the pole along the contact surface, wherein a contact surface indentation is arranged in the contact surface of the bracket, and wherein the contact surface indentation is sufficiently large for at least two bands to be arranged in the contact surface indentation adjacent to each other along the longitudinal axis of the pole.

19. The radio frequency assembly according to claim 11, wherein the radio frequency unit is configured to be attached to an attachment surface with the longitudinal axis in an angle to the attachment surface, wherein the angle is in the interval 0-10°.

* * * * *